US009204749B1

(12) United States Patent
Trapani

(10) Patent No.: US 9,204,749 B1
(45) Date of Patent: Dec. 8, 2015

(54) QUICK RELEASE ANTIMICROBIAL HOSPITAL CURTAIN

(71) Applicant: Vincent Trapani, Bay Shore, NY (US)

(72) Inventor: Vincent Trapani, Bay Shore, NY (US)

( * ) Notice: Subject to any disclaimer, the term of this patent is extended or adjusted under 35 U.S.C. 154(b) by 0 days.

(21) Appl. No.: 14/012,561

(22) Filed: Aug. 28, 2013

(51) Int. Cl.
*A47H 23/08* (2006.01)
*A61G 12/00* (2006.01)

(52) U.S. Cl.
CPC ..... *A47H 23/08* (2013.01); *A61G 12/00* (2013.01)

(58) Field of Classification Search
USPC ..... 160/89, 123, 179, 330
See application file for complete search history.

(56) References Cited

U.S. PATENT DOCUMENTS

| | | | | |
|---|---|---|---|---|
| 2,500,074 | A | 3/1950 | Hill | |
| 2,771,945 | A * | 11/1956 | Wittrup | 160/124 |
| 3,035,275 | A * | 5/1962 | Strebeigh | 4/608 |
| 3,321,003 | A | 5/1967 | Boerner | |
| 4,377,195 | A * | 3/1983 | Weil | 160/237 |
| 5,203,395 | A * | 4/1993 | Koller et al. | 160/263 |
| 5,544,387 | A * | 8/1996 | Yamamoto et al. | 16/87.4 R |
| 5,894,642 | A | 4/1999 | Eberhardt | |
| 6,038,749 | A | 3/2000 | Eberhardt | |
| 6,163,899 | A * | 12/2000 | Leonard | 4/558 |
| 6,192,965 | B1 | 2/2001 | Hinds | |
| 6,394,168 | B1 | 5/2002 | Zoboski | |
| 6,474,396 | B1 * | 11/2002 | Toder | 160/237 |
| 6,739,801 | B2 | 5/2004 | Dreyer | |
| 6,841,244 | B2 * | 1/2005 | Foss et al. | 428/370 |
| 7,254,922 | B2 | 8/2007 | Brockman et al. | |
| 7,350,244 | B1 * | 4/2008 | Handley | 4/558 |
| 7,523,778 | B2 * | 4/2009 | Roberts et al. | 160/237 |
| 7,845,387 | B2 * | 12/2010 | Roberts et al. | 160/237 |
| 7,909,082 | B2 | 3/2011 | Peoples | |
| 8,127,370 | B2 * | 3/2012 | Nunn | 2/69 |
| D671,782 | S * | 12/2012 | Braimah et al. | D6/575 |
| 8,464,365 | B1 * | 6/2013 | Nunn et al. | 2/227 |
| 2005/0278923 | A1 * | 12/2005 | Wu | 29/408 |
| 2006/0000013 | A1 * | 1/2006 | Peoples | 4/558 |
| 2006/0026747 | A1 * | 2/2006 | Prabhakar | 4/558 |
| 2006/0263330 | A1 * | 11/2006 | Emeta et al. | 424/78.37 |
| 2006/0266483 | A1 * | 11/2006 | Roberts et al. | 160/179 |
| 2007/0261803 | A1 * | 11/2007 | Alexander et al. | 160/341 |
| 2007/0284058 | A1 * | 12/2007 | Peoples | 160/123 |
| 2008/0283202 | A1 * | 11/2008 | Serio, III et al. | 160/123 |
| 2011/0165013 | A1 * | 7/2011 | Trybus et al. | 420/479 |
| 2011/0168340 | A1 * | 7/2011 | Squillante | 160/330 |
| 2012/0018106 | A1 * | 1/2012 | Robledo | 160/330 |
| 2012/0117708 | A1 * | 5/2012 | Trapani | 2/83 |
| 2012/0222826 | A1 | 9/2012 | Foss et al. | |
| 2014/0069591 | A1 * | 3/2014 | Mayer | 160/84.04 |

FOREIGN PATENT DOCUMENTS

| | | |
|---|---|---|
| CN | 202312775 | 7/2012 |
| CN | 202619303 | 12/2012 |

* cited by examiner

*Primary Examiner* — Katherine Mitchell
*Assistant Examiner* — Justin Rephann
(74) *Attorney, Agent, or Firm* — Michael I. Kroll

(57) ABSTRACT

A quick release antimicrobial hospital curtain is disclosed. The curtain is made up of a ventilated top portion attached by curtain carriers and eyelets to the existing curtain track, and a bottom portion, the bottom portion being impregnated with an antimicrobial material and woven through with elemental silver threads. The quick release mechanism is a breakaway zipper, also preferably made of an antimicrobially impregnated polymer that may be unfastened either with a conventional zipper handle or simply pulled to detach the bottom portion from the upper.

2 Claims, 7 Drawing Sheets

QUICK RELEASE ANTIMICROBIAL HOSPITAL CURTAIN

BACKGROUND OF THE INVENTION

1. Field of the Invention

The present invention relates generally to hospital curtains and, more specifically, to a quick release hospital curtain consisting of a ventilated narrow upper portion slideably attached along an existing ceiling track. A wide lower portion of the curtain fabricated out of an antimicrobial fabric is removably attached to the narrow upper portion by a breakaway longitudinally extending zipper placed therebetween. A vertical flap secured by VELCRO can be lifted up to access a cover strip to expose a starting point of the zipper on one side of the curtain, so that the wide lower portion can be pulled away from the narrow upper portion.

2. Description of the Prior Art

There are other hospital curtains which provide for an enclosure utilized for hospital beds, surgical facilities, emergency rooms, intensive care units and recovery rooms. While these hospital curtains may be suitable for the purposes for which they where designed, they would not be as suitable for the purposes of the present invention as heretofore described.

It is thus desirable to provide a quick release hospital curtain comprising a narrow ventilated upper portion that is slideably mounted by curtain carriers to an existing ceiling track. A wide antimicrobial lower portion is removably attached by a zipper to the narrow upper portion. A vertically disposed VELCRO flap can access a cover strip to expose a starting point of the zipper allowing the wide lower portion to be pulled away or removed from the narrow upper portion.

SUMMARY OF THE PRESENT INVENTION

A primary object of the present invention is to provide a quick release hospital curtain, in which an antimicrobial lower portion can be easily removed from a thinner upper portion.

Another object of the present invention is to provide a quick release hospital curtain, in which the lower portion is fabricated out of an antimicrobial fabric.

Yet another object of the present invention is to provide a quick release hospital curtain, in which the narrow upper portion is ventilated.

Still yet another object of the present invention is to provide a quick release hospital curtain, in which a top segment of the narrow upper portion is fabricated out of a mesh material Another object of the present invention is to provide a quick release hospital curtain having a breakaway longitudinally extending zipper between the narrow upper portion and the wide lower portion.

Yet another object of the invention is to provide a quick release hospital curtain wherein the breakaway longitudinally extending zipper may additionally be manufactured with an antimicrobial material.

Yet another object of the present invention is to provide a quick release hospital curtain containing a vertical VELCRO flap on one side of the curtain affixed at a top end to the narrow upper portion and removably attached at a bottom end to the wide lower portion.

Still yet another object of the present invention is to provide a quick release hospital curtain further containing a cover strip secured by the vertical VELCRO flap affixed to a lower end of the narrow upper portion that can be pulled up to expose the zipper.

Additional objects of the present invention will appear as the description proceeds.

The present invention overcomes the shortcomings of the prior art by providing a quick release hospital curtain consisting of a ventilated narrow upper portion slideably attached along an existing ceiling track. A wide lower portion of the curtain fabricated out of an antimicrobial fabric is removably attached to the narrow upper portion by a breakaway longitudinally extending zipper therebetween. A vertical VELCRO flap can be lifted up to access a cover strip to expose a starting point of the zipper on one side of the curtain, so that the wide lower portion can either be unzipped from or be pulled away from the narrow upper portion.

The foregoing and other objects and advantages will appear from the description to follow. In the description reference is made to the accompanying drawing, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawing, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

DESCRIPTION OF THE REFERENCED NUMERALS

Figure 1:
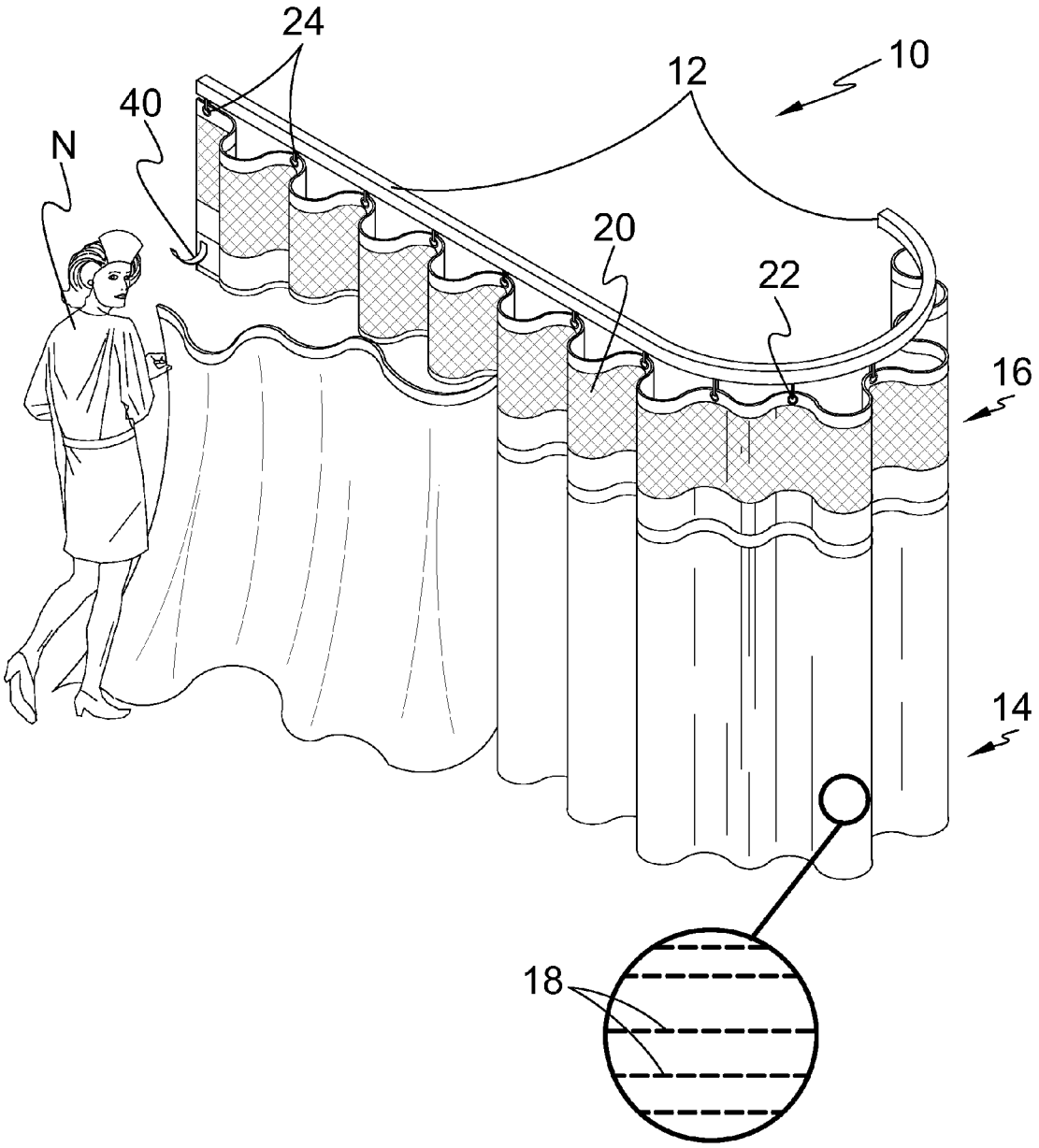
FIG. 1 is a perspective view of the present invention suspended from a track, showing a wide lower portion starting to be separated from a narrow upper portion.

Turning now descriptively to the drawings, in which similar reference characters denote similar elements throughout the several views, the figures illustrate the use of the present invention. With regard to the reference numerals used, the following numbering is used throughout the various drawing figures.

10 hospital curtain
12 curtain track
14 wide lower portion
16 narrow upper portion

18 elemental silver threads
20 upper portion top section mesh
22 curtain carriers
24 eyelets
26 cover strip
28 upper portion top edge
30 upper portion lower edge
32 breakaway zipper
34 upper zipper track
36 lower zipper track
38 interengaged zipper teeth
40 vertically disposed cover strip securing flap
42 curtain left edge
44 curtain right edge
46 zipper handle
48 cooperating VELCRO patches
A1, A2, A3 directional arrows
N user

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments, practitioners skilled in the art will recognize numerous other embodiments as well. For definition of the complete scope of the invention, the reader is directed to appended claims.

FIG. 1 is a perspective view of the present invention 10 suspended from a track 12, showing a wide lower portion 14 starting to be separated from a narrow upper portion 16. The present invention is a quick release hospital curtain 10 comprising a wide lower portion fabricated out of an antimicrobial fabric that includes a plurality of silver threads 18 incorporated into its construction. The elemental silver 18 serves to aid in the antimicrobial protection already provided by the lower portion 14. The invention 10 also includes a narrow ventilated upper portion 16. The upper portion 16 has a top segment 20 made of a mesh material for ventilation and is slideably attached along an existing ceiling track using a plurality of curtain carriers 22 coupled to spaced apart eyelets 24 on a top edge 28 of the narrow upper portion 16. As seen in the following Figures and described more completely below, a cover strip 26 is attached to a lower edge 30 of the narrow upper portion to hide a breakaway zipper 32. The cover strip 26 is held in place by a vertically disposed cover strip securing strap 40. The breakaway zipper 32 extends longitudinally between the wide lower portion 14 and the narrow upper portion 16 of the hospital curtain 10. The breakaway zipper 32 has upper and lower zipper tracks 34, 36 with matingly interlocking teeth 38 that are separable for removing the wide lower portion 14 from the narrow upper portion 16 of the hospital curtain 10 when desired.

Figure 2:
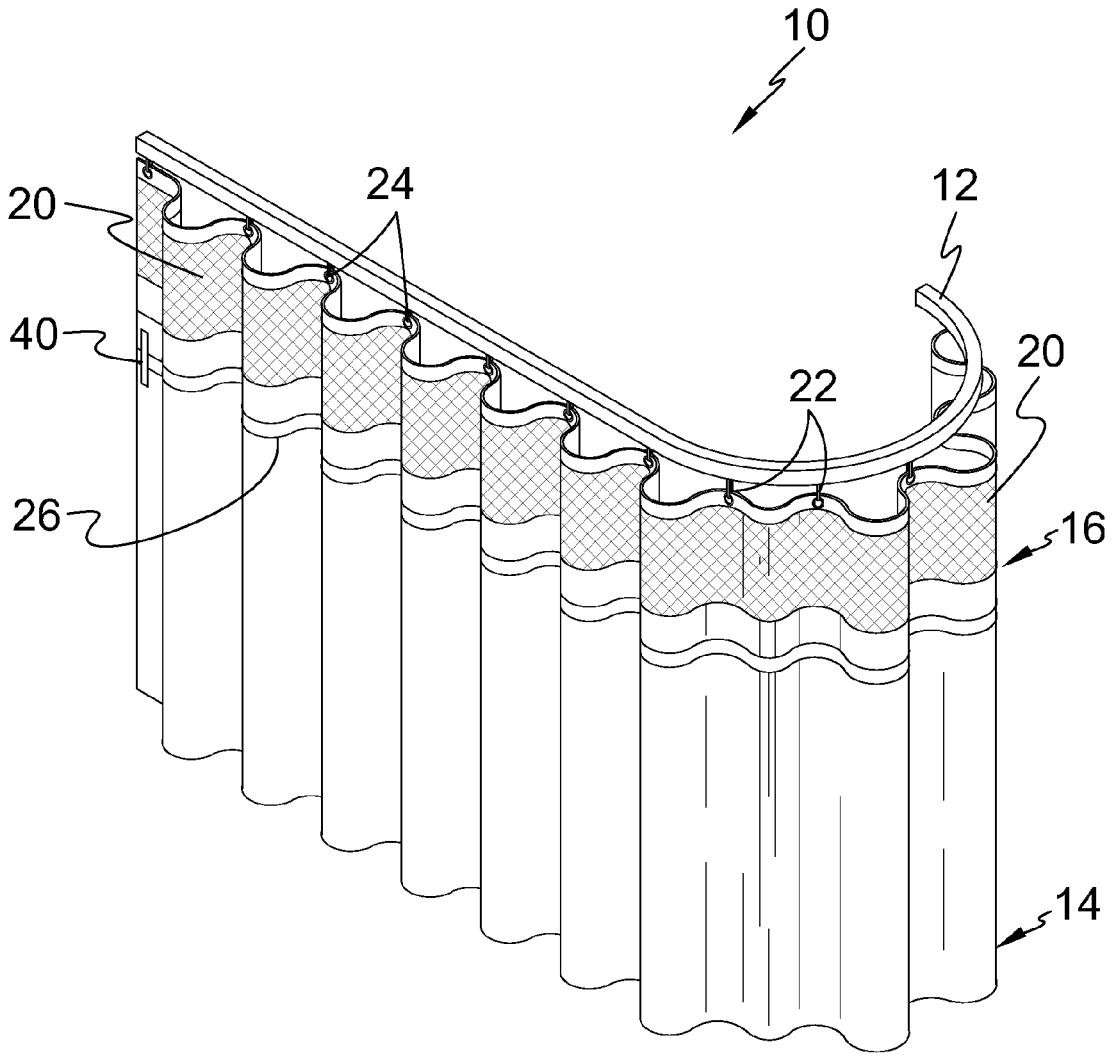
FIG. 2 is a perspective view of the present invention fully assembled.

FIG. 2 is a perspective view of the present invention fully assembled. Shown is the quick release curtain 10 of the present invention comprising the wide lower portion 14 fabricated out of an antimicrobial material and, further, having a plurality of silver threads incorporated therethrough. Also seen is the narrow ventilated upper portion 16. A number of different materials may be used to provide the antimicrobial attributes of the lower portion 14. These various antimicrobial materials may be topically applied periodically or they may be impregnated within the curtain material during the manufacturing process. This, along with the elemental silver threads 18 incorporated in the lower portion 14, provides an impediment to germs in the environment surrounding the bed or examination area by denying a surface where the organisms can multiply. The breakaway zipper 32 (discussed further below) extends fully from the left edge of the hospital curtain to the right edge of the hospital curtain. The breakaway zipper has upper and lower zipper tracks 34, 36 with matingly interlocking teeth 38 that are separable for removing the wide lower portion 14 from the narrow upper portion 16 when the matingly interlocking teeth 38 are disengaged from one another.

Figure 3:
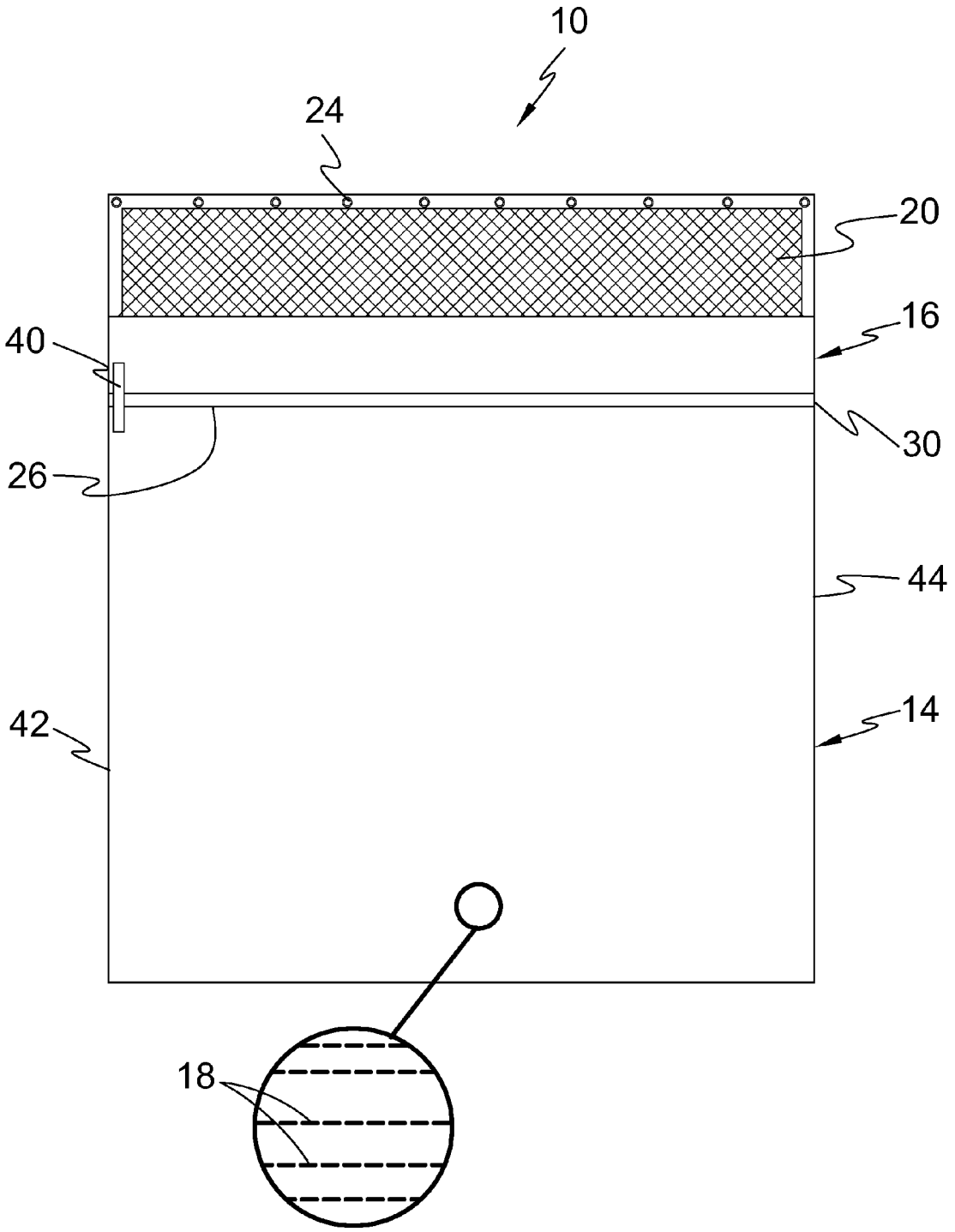
FIG. 3 is a front view of the present invention.

FIG. 3 is a front view of the present invention. The quick release hospital curtain 10 of the present invention provides the cover strip 26 affixed to the lower edge 30 of the narrow upper portion 16 of the hospital curtain 10 to hide the breakaway zipper 32 which extends from the left edge 42 of the hospital curtain 10 to the right edge 44 of the hospital curtain 10. A vertically disposed VELCRO cover strip securing flap 40 is provided and is located on the left hand side 42 of the hospital curtain in the illustrated embodiment.

Figure 4:
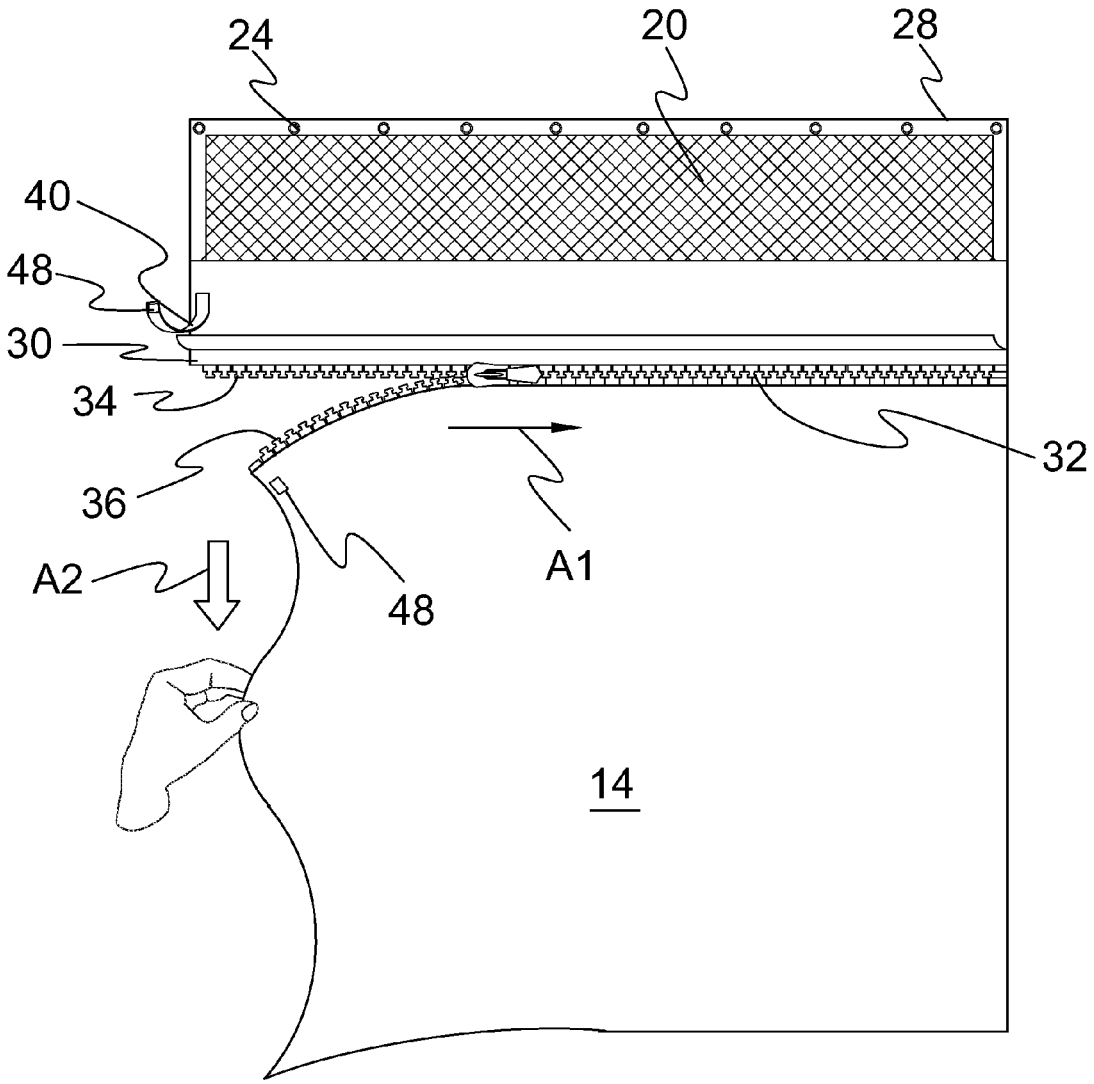
FIG. 4 is a front view of the present invention similar to FIG. 3, showing the wide lower portion starting to be separated from the narrow upper portion.

FIG. 4 is a front view of the present invention similar to FIG. 3, showing the wide lower portion 14 starting to be separated from the narrow upper portion 16. The quick release hospital curtain 10 of the present invention provides the cover strip 26 affixed to the lower edge 30 of the narrow upper portion 16 of the hospital curtain 10 to hide the breakaway zipper 32 which extends from the left edge 42 of the hospital curtain 10 to the right edge 44 of the hospital curtain 10. This breakaway zipper provides a combined breakaway and engagement means that allows a user to remove the antimicrobial lower potion 14 from the upper portion 16 when desired, as will be discussed below. A vertically disposed VELCRO cover strip 40 is provided and is located on the left hand side 42 of the hospital curtain 10 in the embodiment described herein. The vertically disposed VELCRO cover strip 40 is lifted to access and move the cover strip 26 thus exposing the zipper 32 starting point and the zipper handle 46 which may then be used to disengage the interlocking teeth 34, 36 (as indicated by directional arrow A1 in the Figure) to release the wide lower portion 14 from the narrow upper portion 16 of the hospital curtain 10. In the preferred embodiment described herein, the interlocking teeth 34, 36 would be made of a polymer substance and would also be impregnated or infused with an antimicrobial compound similar to the lower portion 14 of the hospital curtain 10. Note also that it is contemplated that in the case of an emergency, if the curtain needed to be removed quickly, the interlocking zipper teeth 34, 36 could be disengaged from one another by simply pulling downwardly as indicated at directional arrow A2 in the Figure, which would also cause the teeth 34, 36 to detach from one another.

Figure 5:
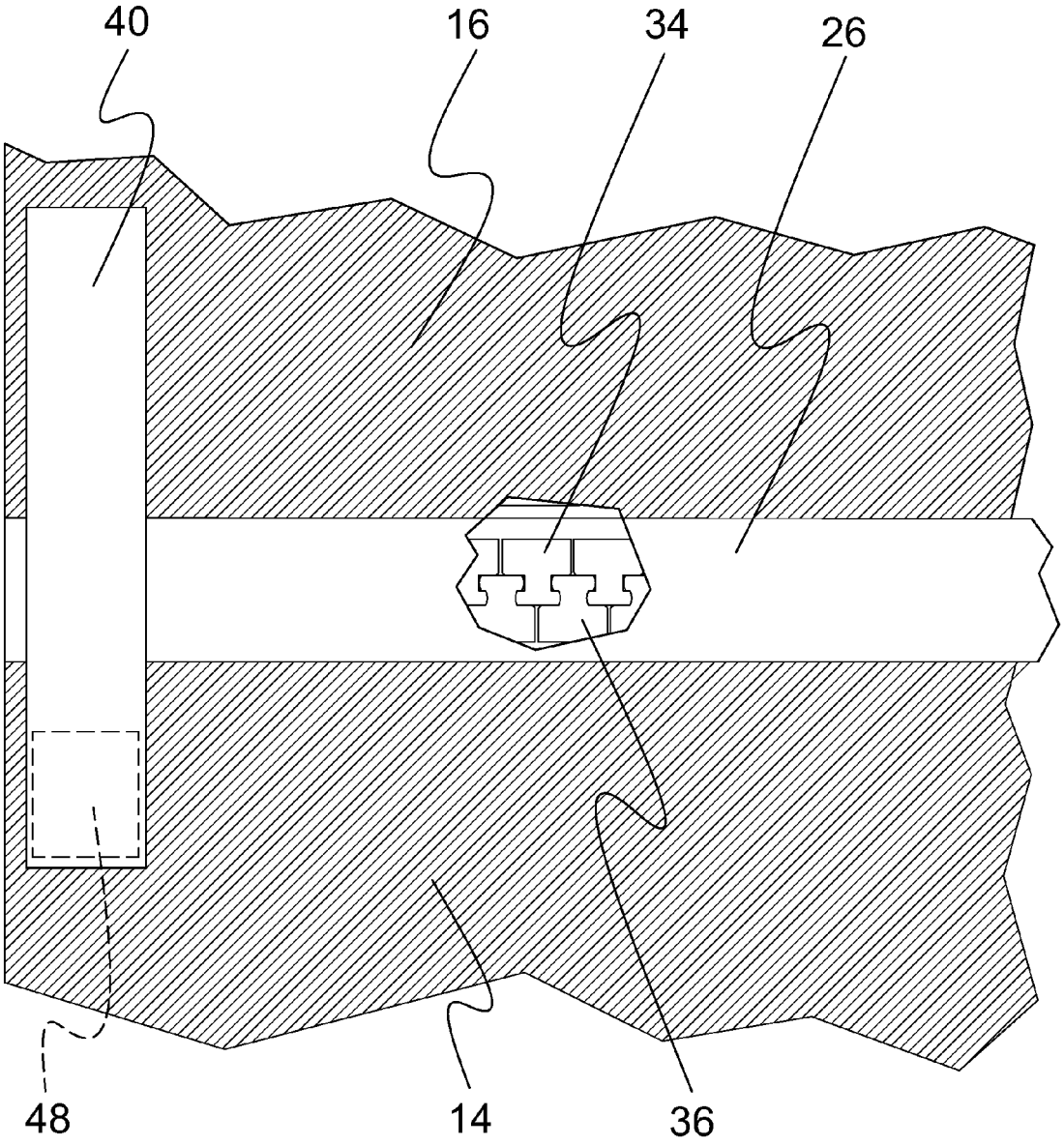
FIG. 5 is an enlarged partial front view of the present invention with parts broken away.

FIG. 5 is an enlarged partial front view of the present invention with parts broken away. Shown is a detailed view of the quick release curtain 10 of the present invention with the vertically disposed VELCRO cover strip 40 in a closed position and the cover strip 26 covering the breakaway zipper 32. Breakaway zipper 32 is shown with the upper zipper track 34 and the lower zipper track 36 engaged with one another. Also shown is the interengaging VELCRO patch 48 disposed on both the VELCRO cover strip 40 and the lower portion 14 (both placements seen in FIG. 4).

Figure 6:
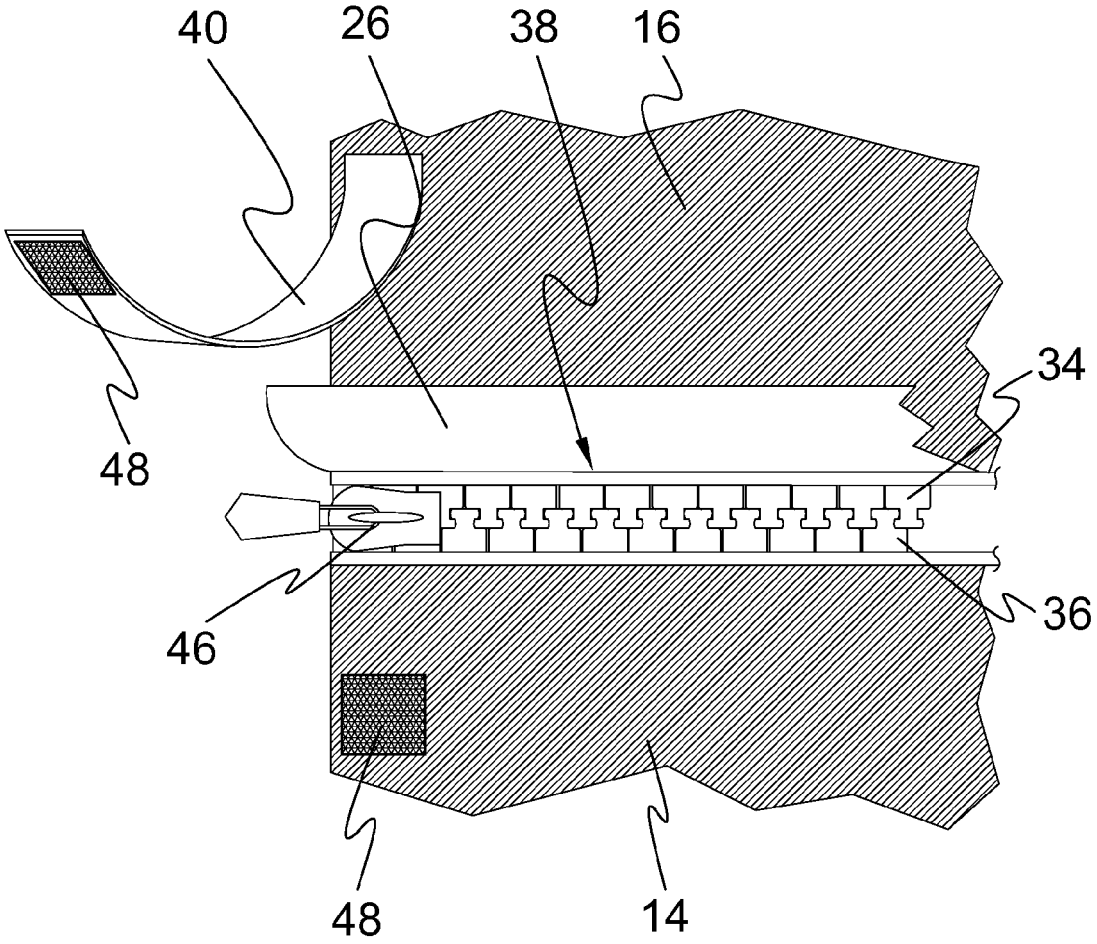
FIG. 6 is an enlarged partial front view of the present invention similar to FIG. 5, showing the VELCRO flap and the cover strip lifted up.

FIG. 6 is an enlarged partial front view of the present invention similar to FIG. 5, showing the vertically disposed VELCRO cover strip 40 and the cover strip 26 lifted up. Shown is a detailed view of the quick release hospital curtain 10 of the present invention comprising the wide lower portion 14 fabricated out of antimicrobial material having the plurality of silver threads 18 incorporated therethrough (as seen in FIGS. 1 and 3). The breakaway zipper 32 extends from the left edge of the hospital curtain to the right edge of the hospital curtain. The breakaway zipper 32 has the upper and lower zipper tracks 34, 36 with the matingly interlocking teeth that are separable for removing the wide lower portion 14 from the narrow upper portion 16 when the matingly interlocking teeth are disengaged.

Figure 7:
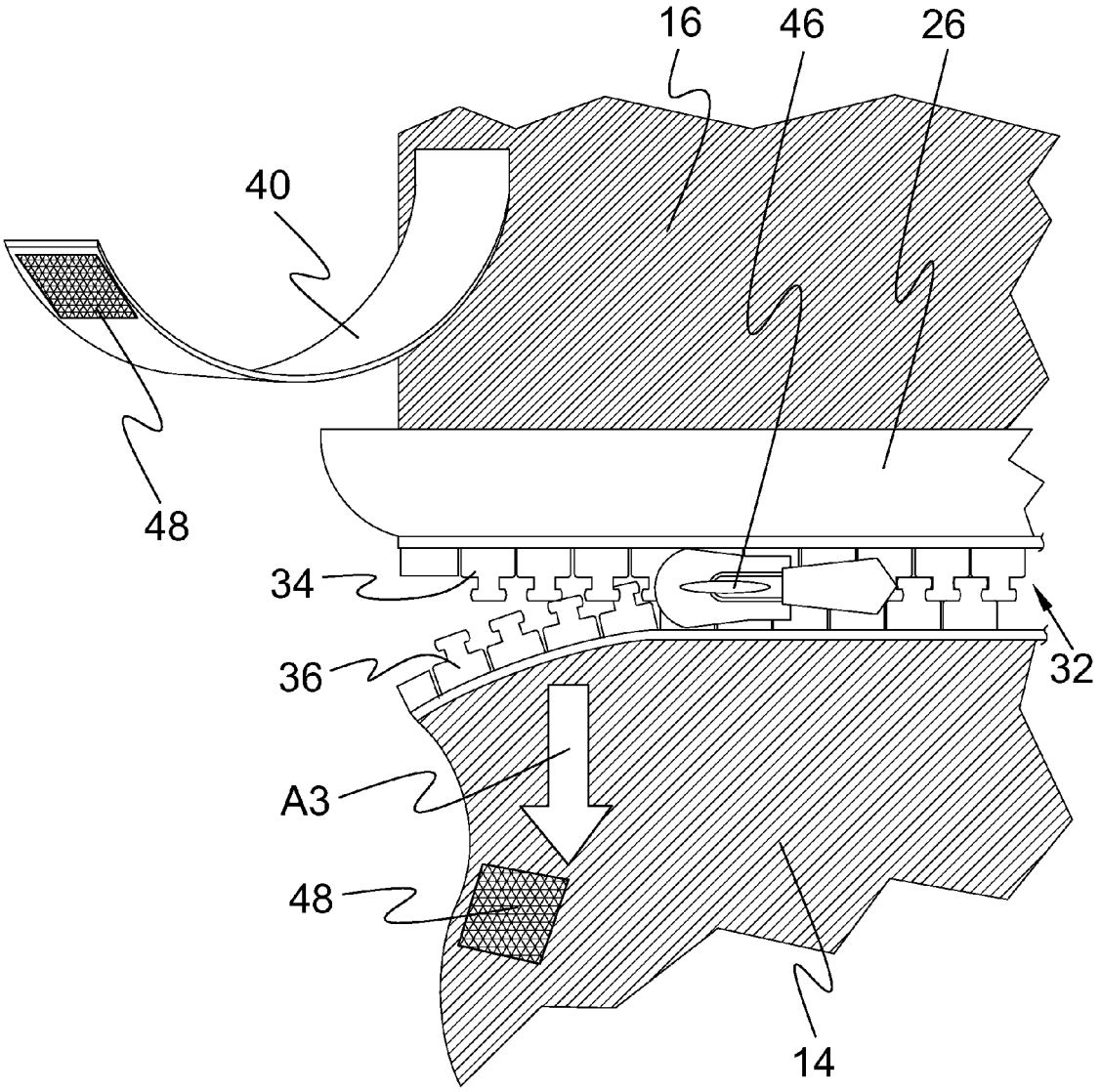
FIG. 7 is an enlarged partial front view of the present invention similar to FIG. 6, showing the zipper being opened and the wide lower portion being pulled away from the narrow upper portion.

FIG. 7 is an enlarged partial front view of the present invention similar to FIG. 6, showing the zipper 32 being opened and the wide lower portion 14 being pulled away from the narrow upper portion 16 as indicated by directional arrow A3. The breakaway zipper 32 has the upper and lower zipper tracks (34 and 36, respectively) with matingly interlocking teeth that are separable for removing the wide lower portion from the narrow upper portion when the matingly interlocking teeth are disengaged as shown. As mentioned above, the user N (seen in FIGS. 1 and 4) may either use the zipper handle, indicated at 46 in the Figures, or may, in case of urgency, simply pull the interengaged teeth apart as shown.

A wide variety of antimicrobial agents are available and would present themselves to the skilled practitioner. In combination with the elemental silver threads 18 the present invention provides a privacy curtain foe hospital room or examination room use. With the rise of infections contracted in hospitals, some of these being partially or substantially resistant to antibiotic treatment, the present invention addresses a real need by denying any airborne organisms or germs unknowingly carried by a person in the environment a surface proximate the patient where the pathogens can rest or multiply. As mentioned above, the antimicrobial material that makes up part of the lower portion 14 of the curtain 10 may be impregnated within the curtain material during the manufacturing process, be topically applied on a predetermined schedule, or both. Additionally, the elemental silver threading 18 incorporated into the lower portion 14 of the present invention increases the antimicrobial properties thereof. It is contemplated that the lower portion 14 of the invention 10 would be easily washable and able to undergo sterilization procedures (high temperatures, chemical treatment, or the like) in case of being badly soiled.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

The invention claimed is:

1. A medical enclosure curtain comprising:

an upper portion, said upper portion including a top edge and a bottom edge, and further including a mesh section adapted to provide ventilation, said mesh section extending partway down said upper portion from said top edge leaving an opaque section of said curtain between said mesh section and said bottom edge, said upper portion additionally including a plurality of eyelets located along said top edge, said eyelets associated with a plurality of curtain carriers, and where said curtain carriers are adapted to cooperate with a curtain track placed about an area to be enclosed;

a lower portion fabricated out of antimicrobial material and also having antimicrobial agents combined therewith;

a curtain left edge and a curtain right edge;

a combined breakaway and engagement means manufactured with antimicrobial material located between said upper portion and said lower portion, said combined breakaway and engagement means extending substantially completely between said curtain left edge and said curtain right edge; whereby said upper portion and said lower portion, engaged to one another may be attached to a curtain track around a desired area, said lower portion antimicrobial agents surround the area and where said lower portion can be completely detached from said upper portion to allow access to the area through said combined breakaway and engagement means;

said combined breakaway and engagement means comprises a pair of cooperating upper and lower zipper teeth, said upper zipper teeth located on said bottom edge of said upper portion and said lower zipper teeth being integral with said lower portion of said medical enclosure curtain, said opaque section extending between a strip of material supporting said upper zipper teeth and said mesh section, said cooperating upper and lower zipper teeth made of a polymer substance impregnated or infused with an antimicrobial compound similar to that used in said lower portion;

a cover strip extending substantially completely from said curtain left edge to said curtain right edge, said cover strip substantially overlying said combined breakaway and engagement means; and a vertically disposed cover strip securing flap adjacent a side edge of said curtain for holding in place said cover strip, said vertically disposed cover strip being integrally attached at an upper end thereof to said upper portion of said curtain, and where said vertically disposed cover strip and said lower portion further include hook and loop type fasteners to secure said vertically disposed cover strip to said lower portion of said curtain to retain said vertically disposed cover strip securing flap over said cover strip, said vertically disposed cover strip securing said horizontal flap not directly securing ends of said upper and lower zipper teeth.

2. The medical enclosure curtain as claimed in claim 1 wherein said antimicrobial agents in said lower portion includes elemental silver threads woven therethrough.

* * * * *